US005637015A

United States Patent [19]

Tan et al.

[11] Patent Number: 5,637,015

[45] Date of Patent: Jun. 10, 1997

[54] SHIELDED ELECTRICAL CONNECTOR

[75] Inventors: Haw-Chan Tan, Diamond Bar; Tim S. L. Chang, Chino Hills, both of Calif.

[73] Assignee: Hon Hai Precision Ind. Co., Ltd., Taiwan

[21] Appl. No.: 522,066

[22] Filed: Aug. 31, 1995

[51] Int. Cl.[6] ..... H01R 13/648

[52] U.S. Cl. ..... 439/607; 439/609

[58] Field of Search ..... 439/92, 95, 108, 439/607, 608, 609, 79

[56] References Cited

U.S. PATENT DOCUMENTS

| | | | |
|---|---|---|---|
| 4,908,335 | 3/1990 | Cosmos et al. | 439/609 X |
| 5,022,871 | 6/1991 | Sekiguchi | 439/609 |
| 5,178,562 | 1/1993 | Ermini | 439/609 |
| 5,288,248 | 2/1994 | Chen | 439/609 |
| 5,378,172 | 1/1995 | Roberts | 439/607 |
| 5,487,682 | 1/1996 | Miller et al. | 439/607 |
| 5,496,195 | 3/1996 | Reed | 439/607 |

*Primary Examiner*—Khiem Nguyen

[57] ABSTRACT

A connector (11) which is of a duplex type, having an insulative housing (12) enclosed by two shells (40, 46) except its bottom face. The housing (12) includes the upper section and the lower section each defining a cavity (14, 16) with a plate (18) horizontally extending therein. Each sections includes therein a plurality of contacts (90) projecting into the corresponding cavity (14, 16). The housing (12) includes plural recesses (76, 78, 80) extending rearward around each cavity (14, 16) for snugly receiving a corresponding number of tangs (56, 64, 70) which project in a backward folded manner from the front edges around the corresponding opening (52, 54) in the front shell (40). Some of such tangs (56, 64, 70) include embossments (84) or kinks (86) thereon for functions as retention means (70) and/or grounding means (56). A pair of spring grounding tangs (47) forward projecting out of the mating face (20) of the connector (11). The front shell (40) includes fastening means (41) to secure to the housing (12) and the rear shell (46) has locking means (55) to be securely fixed to the front shell (40), and thus the housing (12), the front shell (40) and the rear shell (46) form an assembled unit (11).

18 Claims, 9 Drawing Sheets

FIG, 1
(PRIOR ART)

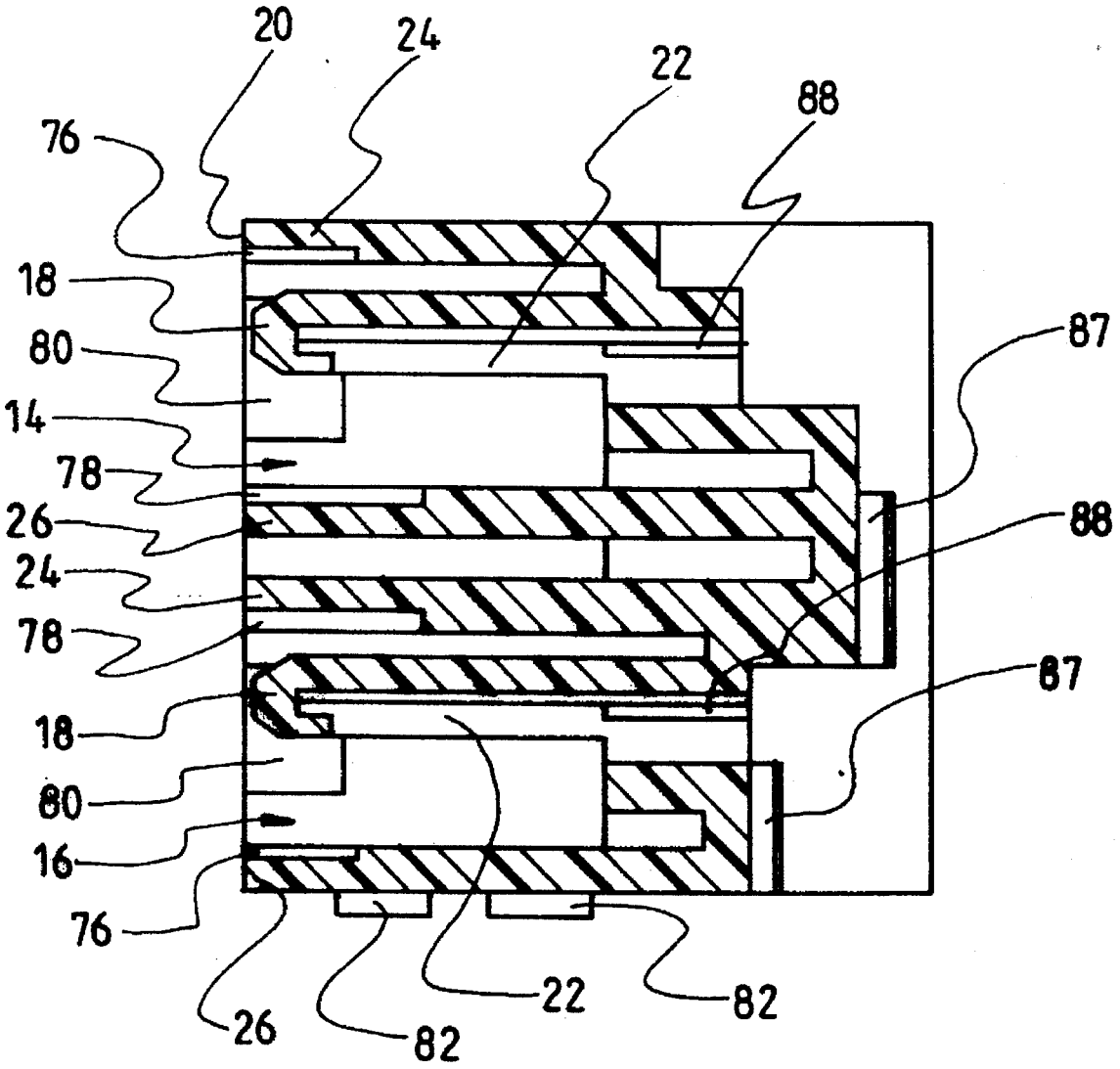
12
FIG, 5

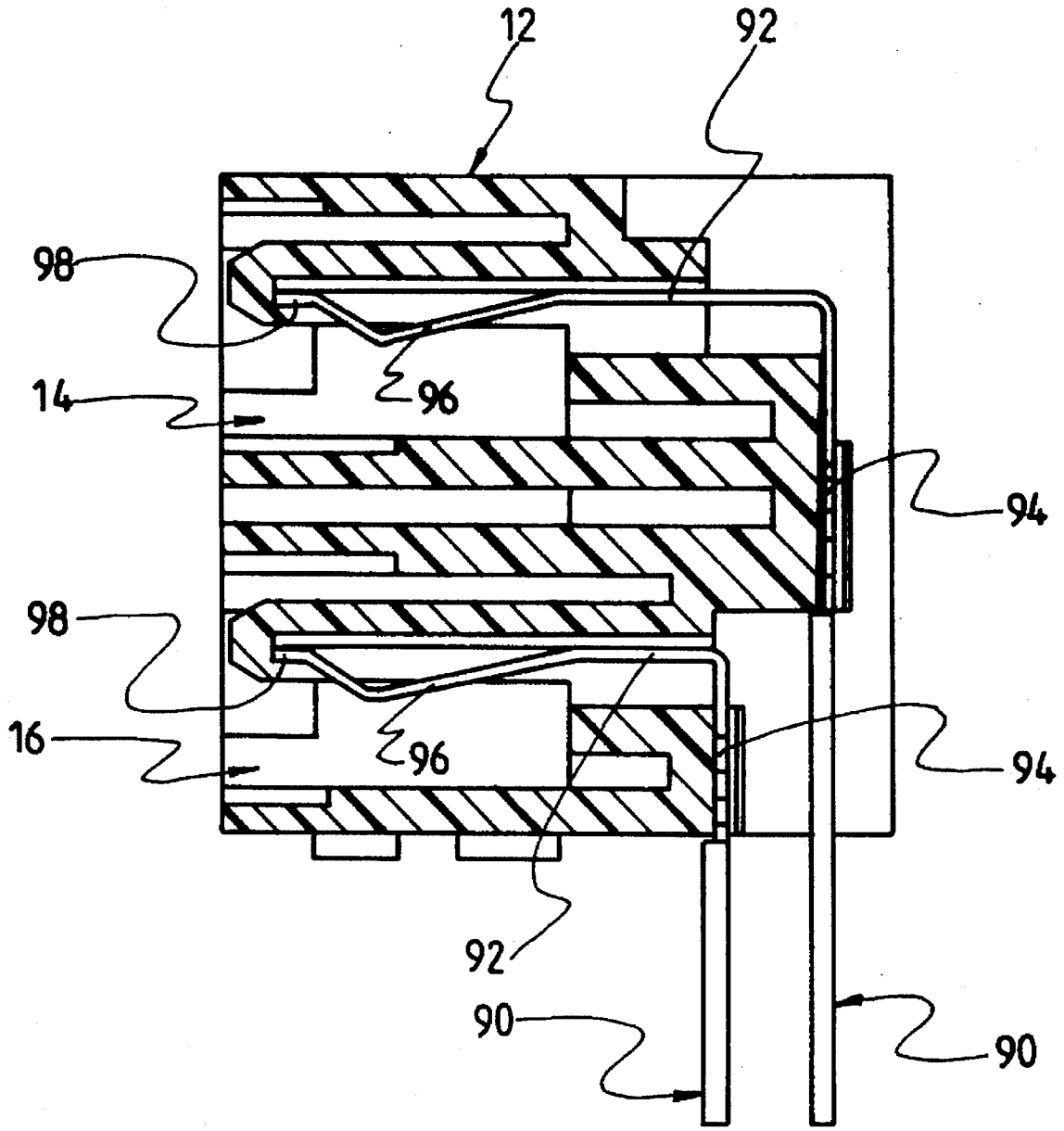
FIG,6

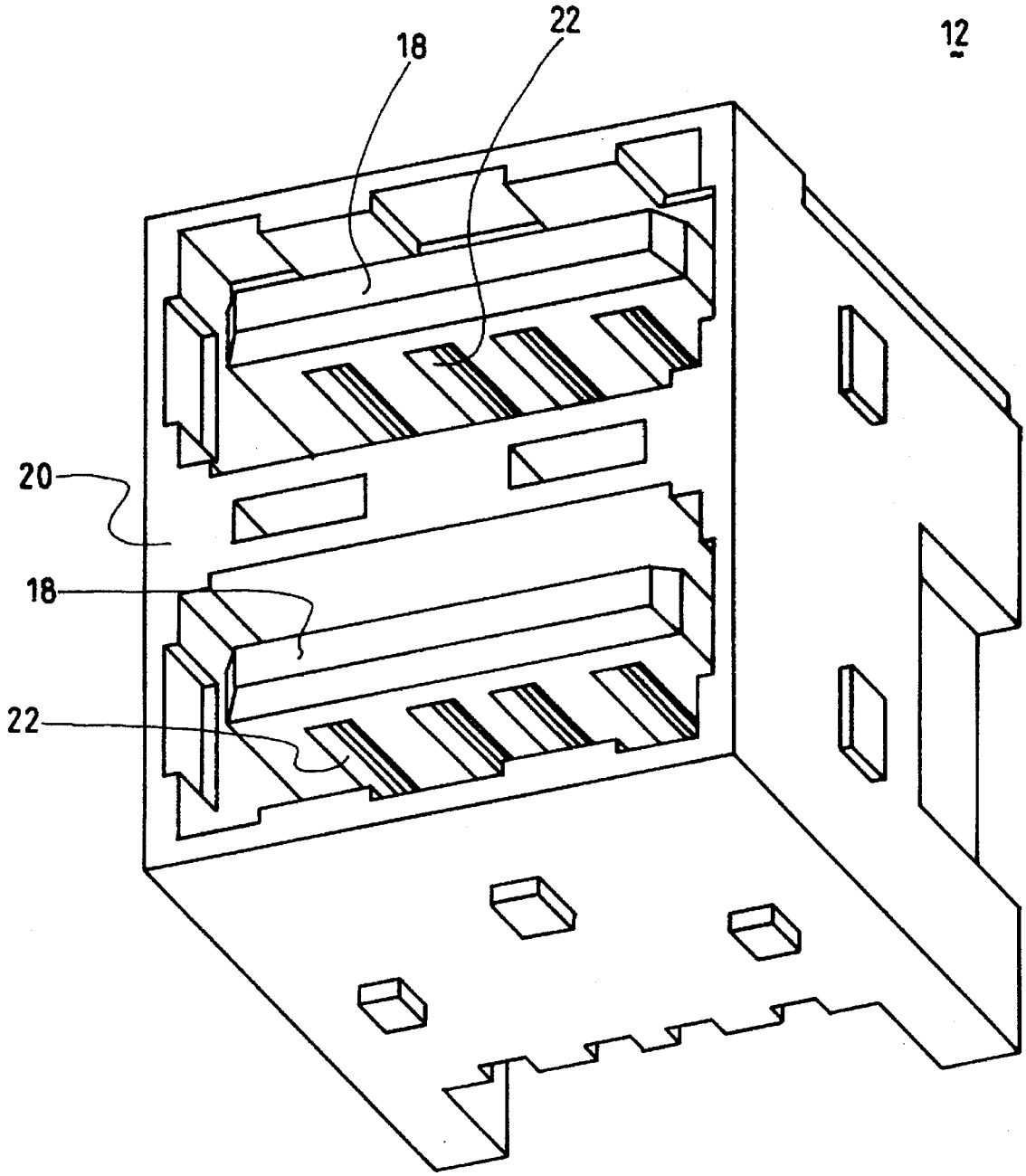
FIG,7

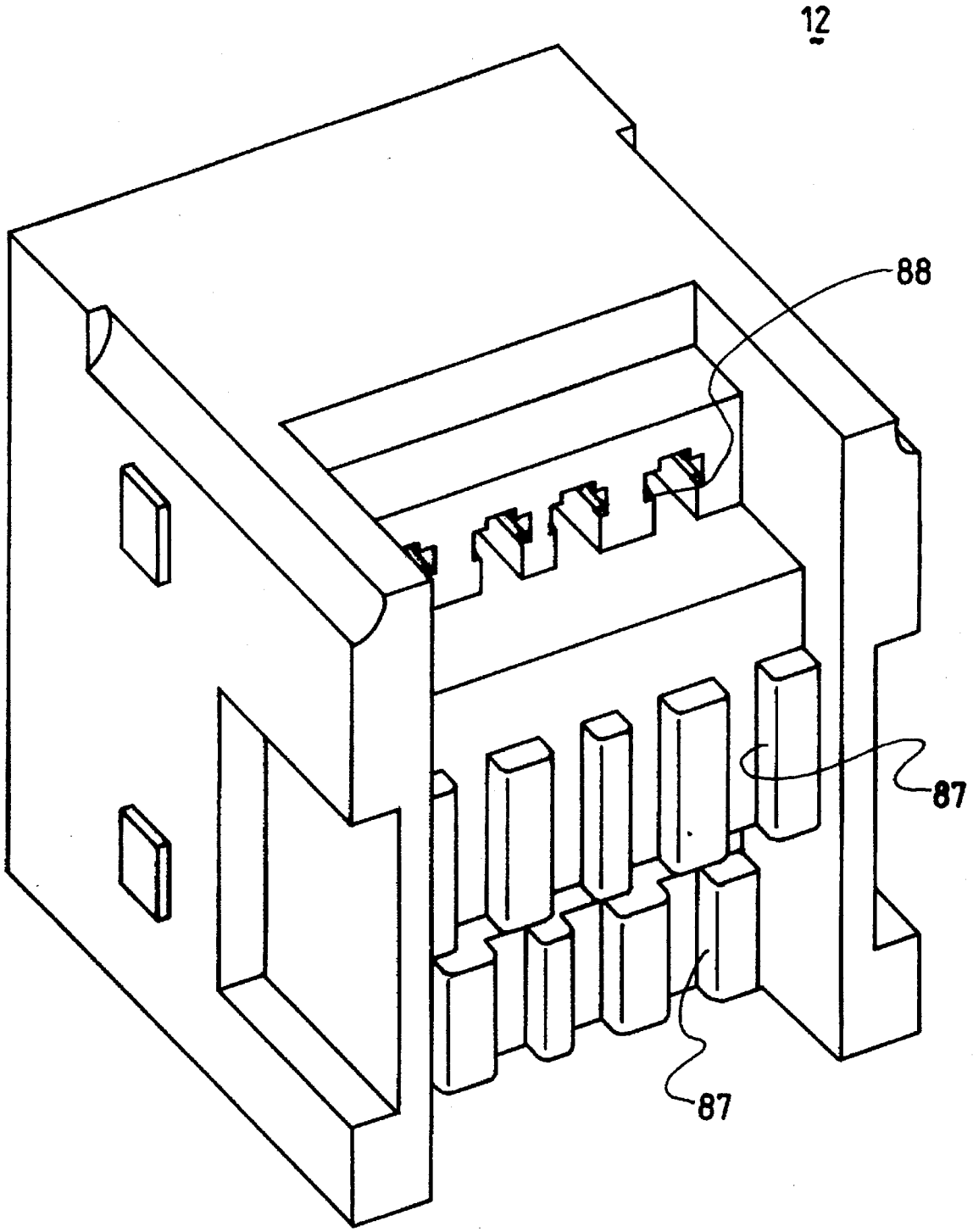
FIG, 8

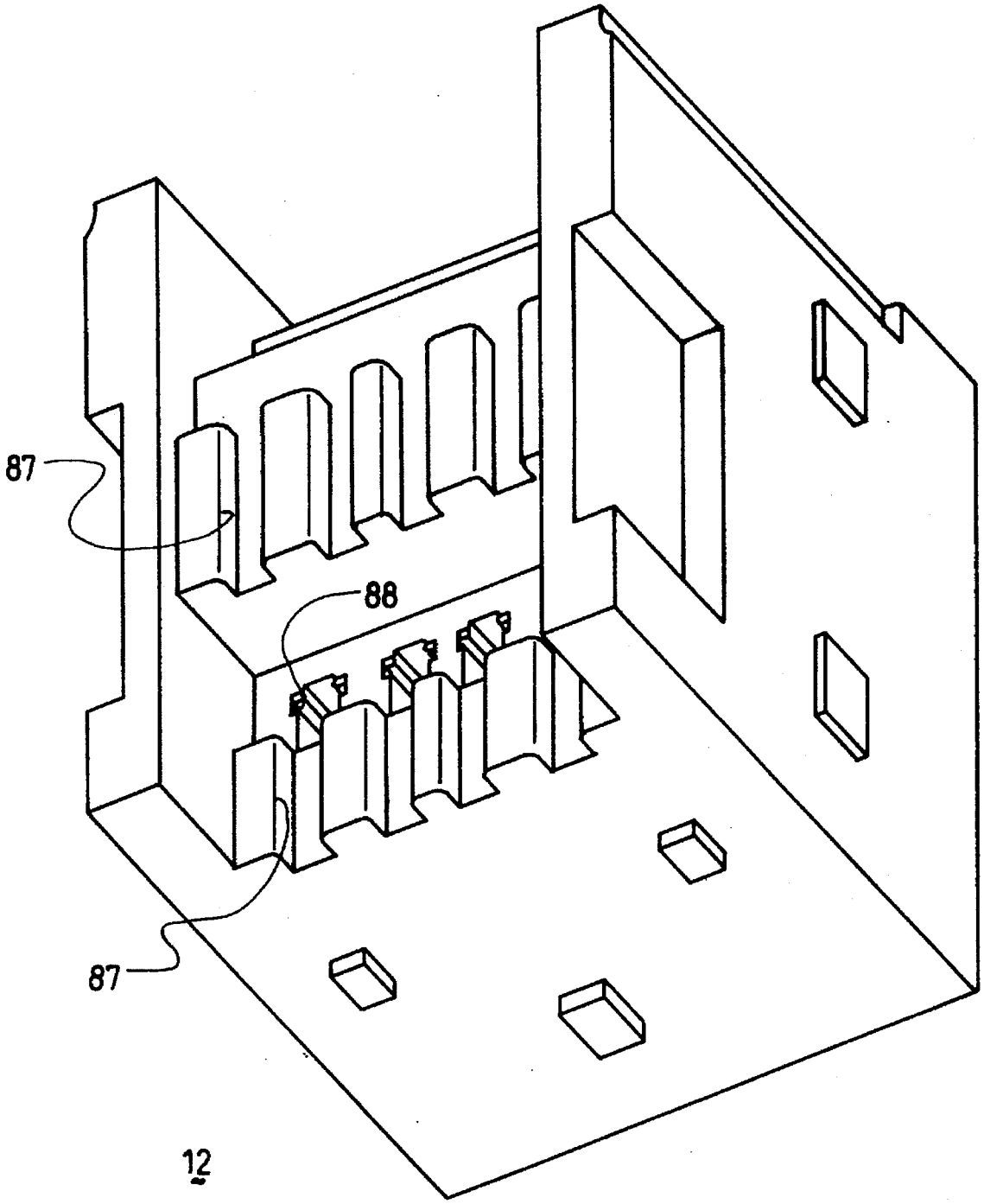
FIG, 9

SHIELDED ELECTRICAL CONNECTOR

BACKGROUND OF THE INVENTION

1. Field of the Invention

The invention relates to electrical connectors, particularly to the USB (Universal Serial Bus) connector having shielding thereon for latchably coupling to a complementary cable connector.

2. The Prior Art

The USB connector is generally a new type connector in the computer field, which is intended to integrate the most different type I/O connectors, such as D-Sub connectors and Mini-Dins, positioned on the backpanel of the computer, to be in a standard form. FIG. 1 shows one type proposed USB connector and its mating corresponding cable connector disclosed in Universal Serial Bus Specification Revision 0.9 wherein the USB connector 1 includes a housing 2 with a shell 3 surrounding the housing 2 and a space 8 between the housing 2 and the shell 3 for mating with a plug section 4 of a complementary cable connector 5 therein for mechanical and electrical connection between the contacts 9 of the USB connector 1 and the contacts 10 of such complementary cable connector 5 whereby at least a pair of spring tangs 6 of the USB connector 1 may be engageably and latchably received within an opening 7 of the plug section 4 of the cable connector 5.

Such proposed USB connector 1 disclosed in FIG. 1 may have the following disadvantages: (1) It lacks a strong structure thereof; (2) the front portion of such USB connector substantially projects out of the backpanel of the computer case, and may form an improper obstacle during handling or shipping the computer case; and (3) the outwardly bent distal end portion 3' of the shell 3 of the USB connector 1 is designedly exposed externally behind the backpanel of the computer case, thus resulting in poor grounding function with the backpanel of the computer case, and also resulting in dangerous edges to hurt the user's fingers during coupling the complementary cable connector 5 to the USB connector 1.

Therefore, an object of the present invention is to provide a USB connector having a reinforcement structure between the outer shield and the inner housing for reliable engagement with the complementary cable connector.

Another object of the invention is to provide a USB connector having means for grounding with the complementary cable connector and also for releasably retaining the complementary cable connector thereto.

Yet an object of the invention is to provide a USB connector having devices for grounding with the backpanel of the computer case.

Another object of the invention is to provide a USB connector having shielding means for covering five faces of its cubic contour except the bottom face which has no shielding attached thereon and is seated on the mother board.

SUMMARY OF THE INVENTION

According to an aspect of the invention, a USB connector assembly which is of a duplex type, having an insulative housing enclosed by two shells except its bottom face. The housing includes the upper section and the lower section each defining a cavity with a plate horizontally extending therein. Each sections includes therein a plurality of contacts projecting into the corresponding cavity. The housing includes plural recesses extending rearward around each cavity for snugly receiving a corresponding number of tangs which project in a backward folded manner from the front edges around the corresponding opening in the front shell. Some of such tangs include embossments thereon for functions as retention means and/or grounding means. A pair of spring grounding tangs forward projecting out of the mating face of the connector. The front shell includes fastening means to secure to the housing and the rear shell has locking means to securely fix to the front shell, and thus the housing, the front shell and the rear shell form an assembled unit.

BRIEF DESCRIPTION OF THE DRAWINGS

FIG. 5 is a cross-sectional view of the housing of the USB connector of FIG. 2 without contacts therein to show the internal structures of passageways.

FIG. 6 is a cross-sectional view of the housing of the USB connector of FIG. 2 with contacts therein.

FIG. 7 is a bottom/front perspective view of the housing of the USB connector of FIG. 2 to show the passageways on the undersurface of the plate within the cavity for receiving the corresponding contacts therein.

FIG. 8 is a top/rear perspective view of the housing to show the rear ends of the upper contact passageways and the channels on the back.

FIG. 9 is a bottom/rear perspective view of the housing to show the rear end of the lower contact passageways and the channels on the block.

DETAILED DESCRIPTION OF THE PREFERRED EMBODIMENT

References will now be made in detail to the preferred embodiments of the invention. While the present invention has been described with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 3:
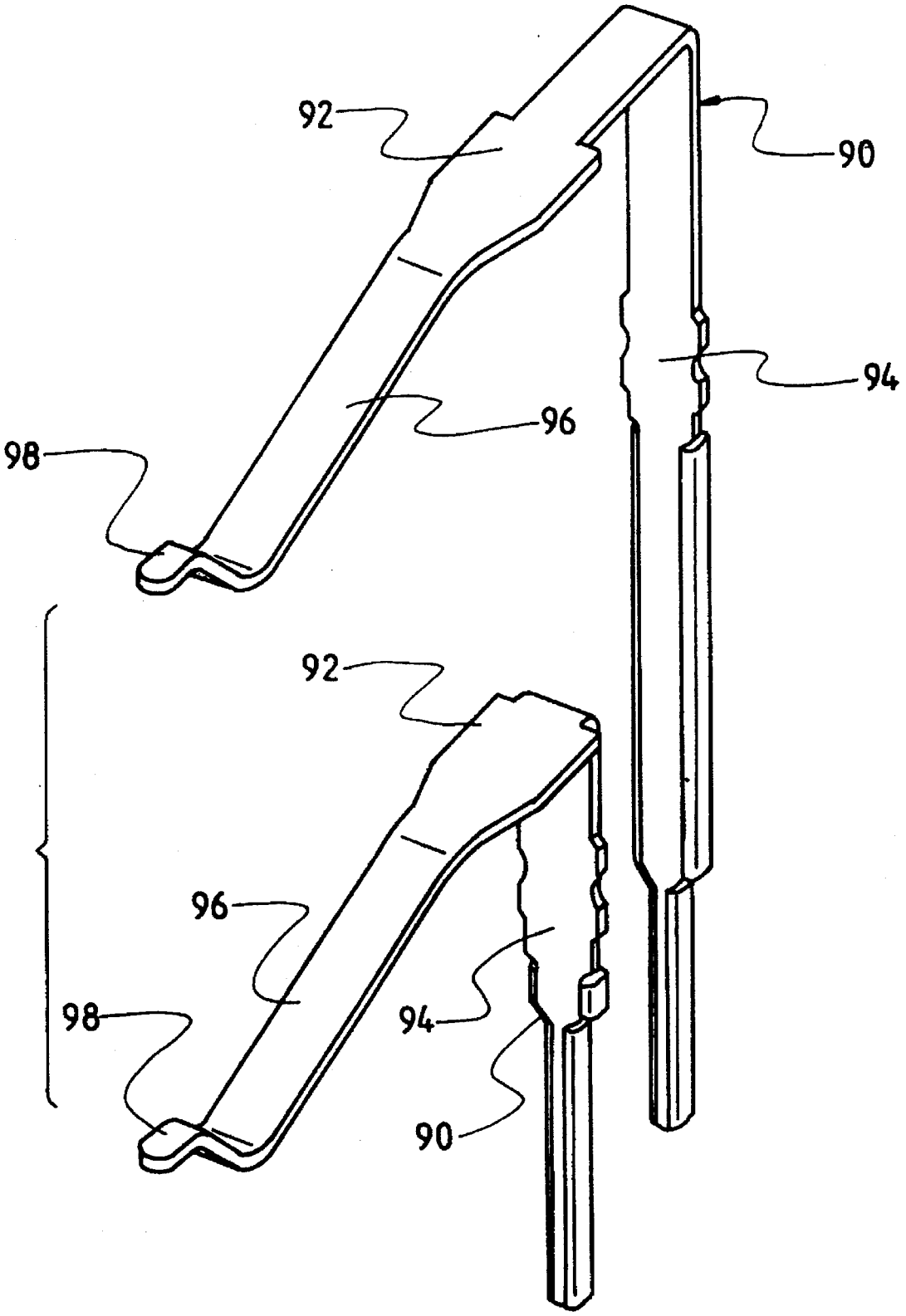
FIG. 3 is a perspective view of the upper contacts and the lower contacts for use within the USB connector of FIG. 2.

It will be noted here that for a better understanding, most of like components are designated by like reference numerals throughout the various figures in the embodiments. Attention is now directed to FIGS. 2–6, a USB connector 11 includes an generally cubic insulative housing 12 defining an upper and a lower cavities 14, 16 therein. In each cavity 14, 16, a horizontal plate 18 extends forwardly to the mating surface 20 of the housing 12. Also referring to FIGS. 5 and 7, corresponding to each horizontal plate 18, a plurality of horizontal passageways 22 side by side extend from the rear portion of the housing 12, along the underside of the horizontal plate 18, to the mating surface 20 wherein each passageway 22 terminate adjacent to the front end of the horizontal plate 18, but substantially does not penetrate thereof. Each passageway 22 is adapted to accommodate one corresponding contact 90 (FIG. 3). The detailed structures of the passageways 22 and of the corresponding contact 90 will be illustrated later.

To define each cavity 14, 16, the housing 12 includes a (first) top wall 24, a (second) bottom wall 26, a (third) side wall 28 and a (fourth) side wall 30 wherein the bottom wall 26 of the upper cavity 14 and the top wall 24 of the lower cavity 16 are commonly initiated from a central wall 32 in opposite directions.

The shield for use with the housing 12 includes a front shell 40 composed of a front face 42 and two sides faces 44, and a rear shell 46 composed of a top face 48 and a rear face 50. The front face 42 of the front shell 40 defines an upper opening 52 and a lower opening 54 corresponding to the cavities 14 and 16 in the housing 12, respectively, wherein around the upper opening 52, a pair of grounding tabs 56 extend rearward from a (third) side edge 58 and a (fourth) side edge 60, and a reinforcement device 62 including three straps 64 rearward extending from a longitudinal (first) top edge 66, and a locking plate 68 including a pair of latching fingers 70 extending rearward from a longitudinal (second) bottom edge 72. The latching fingers 70 includes an embossment 84 thereon for retentively engaging with an engaging opening 7 of the complementary cable connector (referring to FIG. 1). the grounding tab 56 also may be configured to have a kink 86 thereon for enhancing the grounding performance between such grounding tab 56 and the outer shell of the inserted complementary cable connector. It should be understood that in this embodiment, the structures of the front face 42 of the front shell 40 around the upper opening 52 and the lower opening 54 are of a symmetrical mirror image manner with regard to a central portion 74 of the front face 42 of the front shell 40. Thus, the reinforcement device 62 which extending from the top edge 66 of the upper opening 52 and is not shown explicitly in FIG. 2 due to the viewing position, may be easily referred to the reinforcement device 62 shown around the lower opening 54 thereof, which is substantially the same as that of the upper opening 52 except that the reinforcement device 62 of the lower opening 54 is positioned on the bottom edge 72 thereof while the reinforcement device 62 of the upper opening 52 is located on the top edge 72 of the upper opening 52. Understandably, the locking plate 68 of the lower opening 54 is also has the similar relation with regard to that of the upper opening 52.

Figure 1:
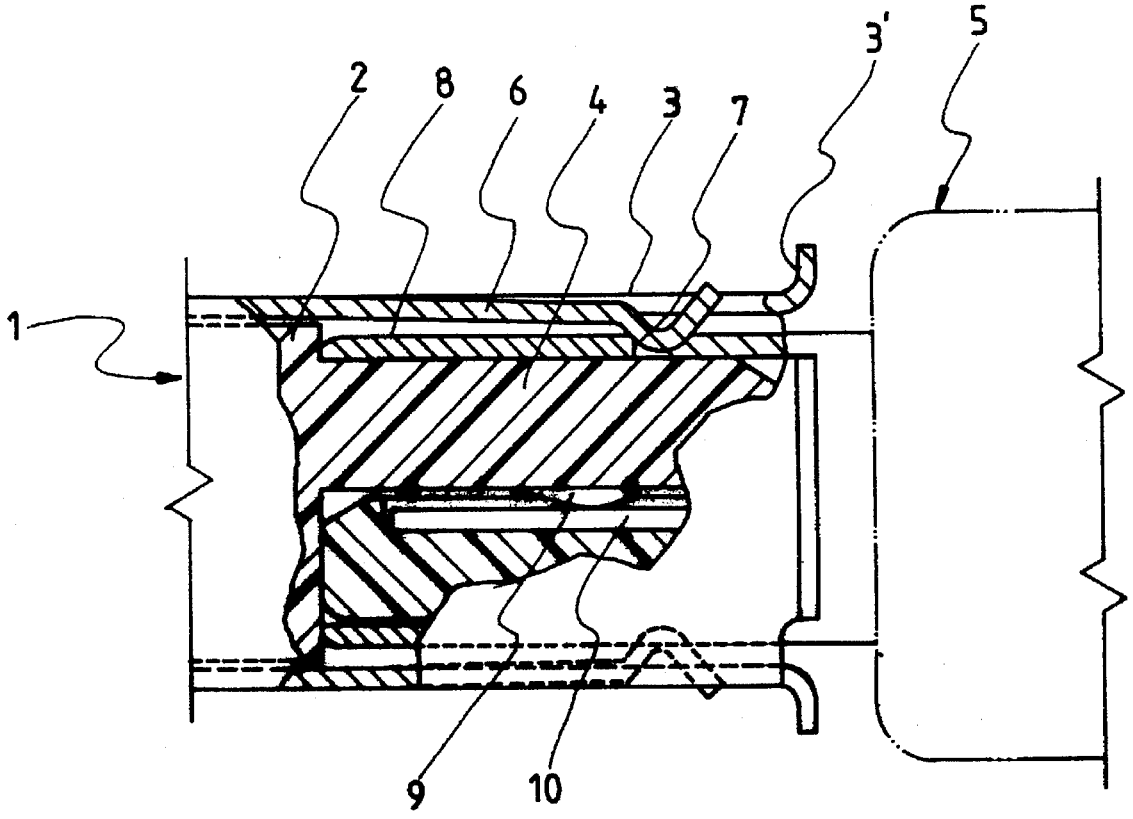
FIG. 1 is a side and partially cross-sectional view of a prior art USB connector.
Figure 2:
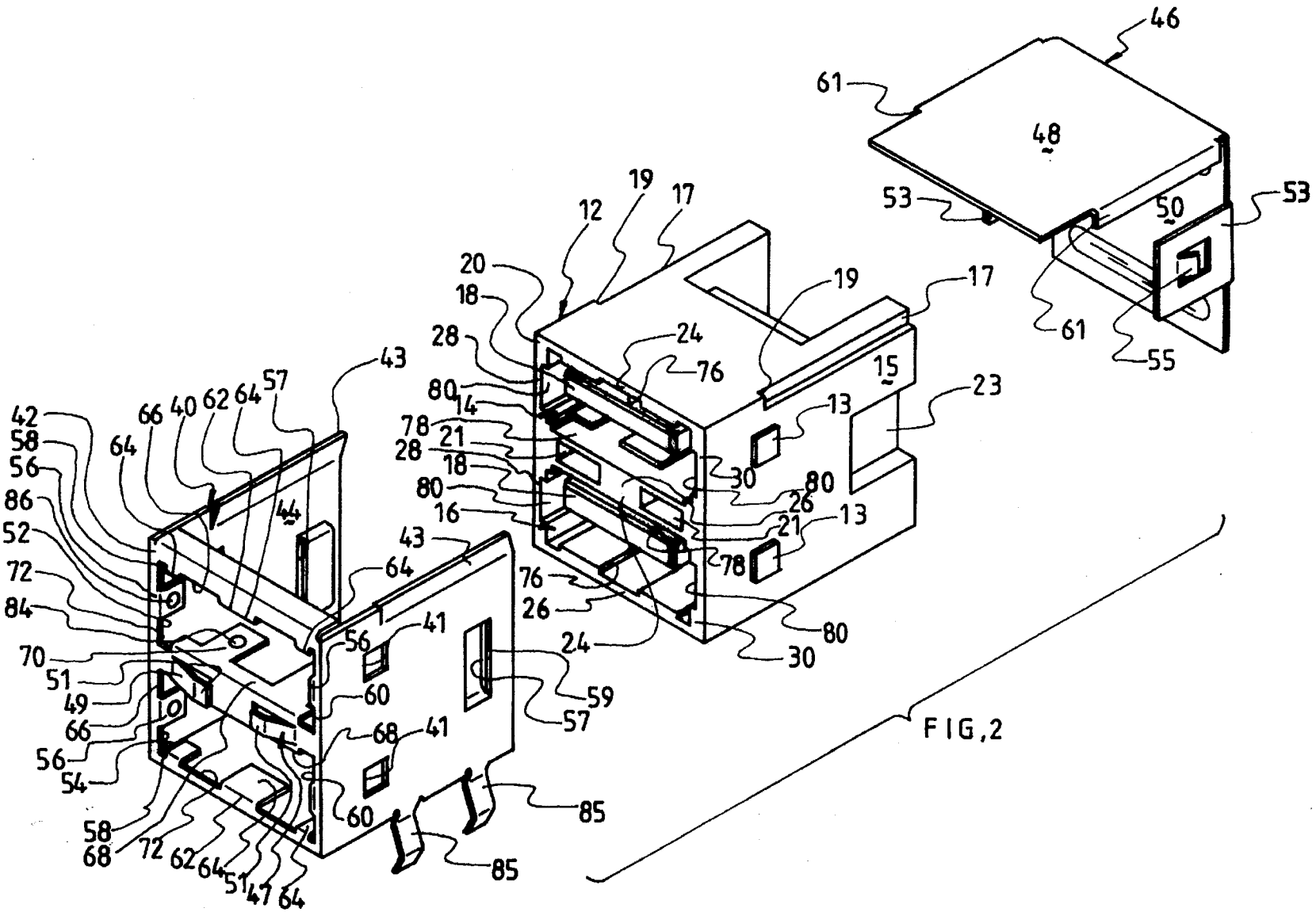
FIG. 2 is an exploded perspective view of a USB connector of an presently preferred embodiment according to the invention, without showing contacts thereof.

Corresponding the aforementioned structures around the upper and lower opening 52 of the front shell 40, the housing 12 around the upper cavity 14 includes first recesses 76 in the top wall 24, a second recess 78 in the bottom wall 26 and a pair of third recesses 80 in the side walls 28 and 30, respectively, for respective receipt of the corresponding reinforcement device 62, the locking plate 68 and the grounding tabs 56 of the front shell 40 therein. Certainly, the top wall 24, the bottom wall 26 and the side walls 28, 30 around the lower cavity 16 also have the similar recesses, respectively, for conformably respectively receiving the corresponding structures of the front shell 40 around the lower opening 54. It can be noted that because such first, second and third recesses 76, 78 and 80 surround the cavities 14, 16, for generally fully receiving the corresponding reinforcement device 62, the locking plate 68 and the grounding tabs 56 therein, respectively, the cavities 14, 16 of the housing 12 may keep the designedly desired dimension for properly grasping the complementary cable connector 5 as shown in FIG. 1, therein without any improper physical interference.

To secure the front shell 40 to the housing 12, the housing 12 includes plural protrusions 13 on its two side surfaces 15 for engagement within a corresponding number of apertures 41 in the side faces 44. The housing further includes a pair of shallows 17 on its two top corner sections forward extending from the rear portion and each forms a step 19 at an end such that a pair of inwardly deflected strips 43 on the top of the side faces 44 of the front shell 40 may be latchably received within such pair of shallows 17 wherein the steps 19 provide stopper function of preventing the front shell 40 from moving forwardly.

The front face 42 of the front shell 40 further includes a pair of grounding tangs 47 obliquely and forwardly extending therefrom for engagement with an interior engagement surface of a backpanel (not shown) of the computer case (not shown) because the subject connector 11 is designedly disposed inside the computer case (not shown). Each tang 47 generally includes a main body 49 and a deflected end portion 51. Correspondingly, the housing 12 includes a pair of indents 21 recessed rearward from the mating surface 20 thereof for receiving the corresponding grounding tangs 47 of the front shell 40 therein. Thus, the connector 11 is designedly disposed within the computer case wherein the mating face 20 substantially abuts against the interior surface of the backpanel of the computer case. In this situation, the main body 49 of the grounding tangs 47 of the front shell 40 also confront the same interior surface of the backpanel while the deflected end portions 51 of the tangs 47 can be substantially received within the corresponding indents 21 in the housing 12.

Figure 4:
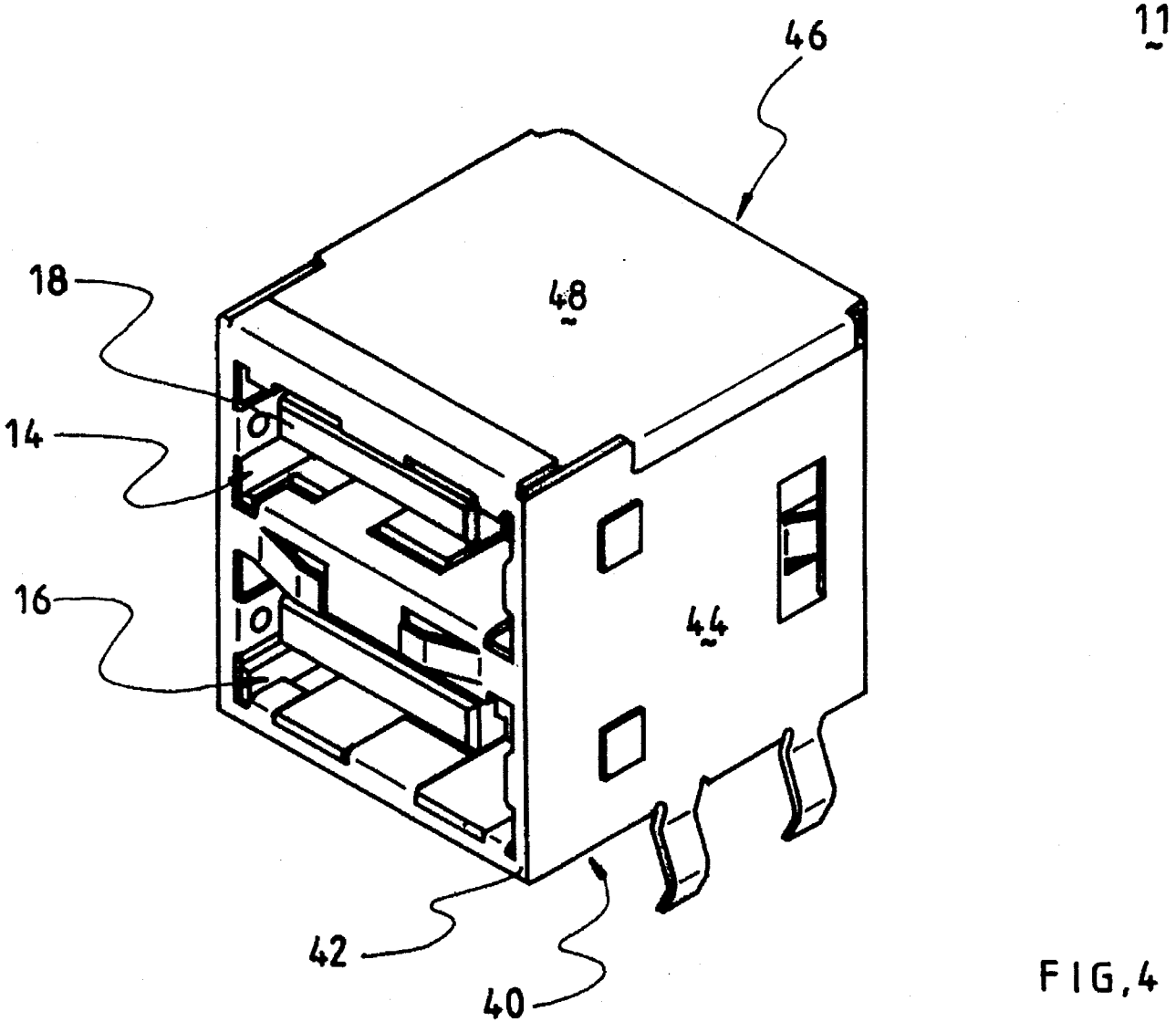
FIG. 4 is a perspective view of an assembled USB connector of FIG. 2 without showing contacts thereof.

The rear shell 46 further includes a pair of securement ears 53 respectively extending forward from the two side edges of the rear face 50 wherein each securement ear 53 including a locking tag 55 extending outwardly. Correspondingly, the front shell 40 also includes a pair of slit sections 57 formed by splitting the corresponding portions of the side faces 44. Therefore, the front shell 40 and the rear shell 46 are adapted to be fixed to each other by means that the securement ears 53 of the rear shell 46 respectively extend through the corresponding slit section 57 of the front shell 40 and the locking tags 55 of the securement ears 53 engage the locking edges 59 of the front shell 40 beside the slits 57. To comply with the securement ears 53, the housing 12 includes a pair of recessions 23 on two side surfaces 15 for receiving such securement ears 53 therein. The rear shell 46 includes a pair of prolonging bars 61 downward extending from two side edges of the top face 48 for sitting on the corresponding deflected strips 43 of the front shell 40 so that the whole assembly of the connector has a generally flat configuration around this area (FIG. 4).

Referring to FIGS. 2 and 5–9, as aforementioned, each cavity 14, 16 or each horizontal plate 18 corresponds to a plurality of passageways 22 and their corresponding contacts 90 therein. Each passageways 22 has a pair of narrowed slots 88 on two sides for interferentially engaging a pair of expanded retention sections 92 of the contacts 90 therein for retaining the contacts 90 in position. The rear portion of the housing includes a plurality of vertical channels 86 corresponding to the contacts 90 for interferentially receiving the vertical tail sections 94 therein for alignment consideration, i.e., assuring the tips of the tail section 94 of the contacts 90 to be in the right positions with regard to the holes in the mother board (not shown) on which the connector 11 is mounted.

Each contact 90 further includes an engaging section 96 downward and forward projecting from the retention section 92 wherein the distal end 98 of the engaging section 96 generally is deflected upwardly for being adapted to be protectively embedded within the corresponding passageway 22 and for not being exposed to an exterior.

As noted in this embodiment, the front shell 40 includes the mounting legs 85 extending downward from the bottom edge of the side faces 44, and the housing 12 includes standoffs 82 on its bottom surface. Those structures are all generally of functional designs well known to persons in this field.

As assembled, the reinforcement device 62 of the front shell 40 incorporating the housing 12, may enhance the structure strength of the whole connector assembly, the latching fingers 70 may latchably engage the outer shell of the inserted complementary cable connector, and the grounding tabs 56 may efficiently conductively contact the outer shell of the complementary cable connector wherein cooperation with the recesses 76, 78 and 80 of the housing 12, such reinforcement device 62, the locking plate 68 and the grounding tabs 56 of the front shell 40 still leave a properly configured space within the cavities 14, 16 of the housing 12 for receiving the inserted complementary cable connector.

One feature of the invention is that the front shell 40 of the connector 11 is made by stamping and forming a plate blank wherein the reinforcement device 62, the locking plate 68 and the ground tabs 56 are all formed by bending and stamping the material of the raw blank and leaving a predetermined dimensioned opening 52, 54 therein. In other words, the material of the reinforcement device 62, the locking plate 68 and the grounding tabs 56 are all derived from the material substantially defined within the range of the corresponding opening 52, 54 on the raw plate blank. Therefore, the reinforcement device 62, the locking plate 68 and/or the grounding tabs 56 should be configured in a stagger arrangement on the raw (i.e. unstamped and unformed) plate blank for not overlapping with each other to assure they all have sufficient dimensions for their own strength consideration. Thus, it can be seen that the straps 64 of the reinforcement device 62 are substantially designedly offset from the latching fingers 70 of the locking plate 68 in the horizontal direction.

Even though this embodiment discloses a duplex type connector assembly which is composed of two stacked cavities 14, 16 for respectively receiving a duplex type cable connector which has two plug portions, it can be understood that the simplex type connector also may be implemented under the features or the spirit of this invention.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

What is claimed is:

1. A shielded electrical connector for latchably coupling to a complementary cable connector having a plug section on a front portion, comprising:

an insulative unitary housing defining at least one cavity therein;

a horizontal plate suspensively extending integrally with the housing and within said cavity;

a plurality of passageways extending along said horizontal plate in a front-to-end direction for receiving a corresponding number of contacts therein; and a front shell including at least a front face defining an opening therein in alignment with the cavity in the housing;

wherein said front shell includes a plurality of different means integrally extending rearward from fully circumferential edges by said opening, and the housing includes a corresponding number of different recesses extending rearward in fully surrounding walls by said cavity for receiving said corresponding different means of the front shell therein, respectively.

2. The shielded electrical connector as described in claim 1, wherein one of said recess is a first recess and one of said means is a reinforcement device.

3. The shielded electrical connector as described in claim 1, wherein one of said recess is a second recess and one of said means is a locking plate having at least an embossment thereon.

4. The shielded electrical connector as described in claim 1, wherein one of said recess is a third recess and one of said means is a grounding tab.

5. The shielded electrical connector as described in claim 1, wherein some of said means are substantially offset with each other in a horizontal direction.

6. The shielded electrical connector as described in claim 1, wherein said front shell further includes at least a grounding tang forwardly and obliquely extending from the front face, and said housing further includes at least an aperture extending rearward from a mating surface of the housing for reception of said grounding tang therein.

7. The shielded electrical connector as described in claim 1, wherein said front shell further includes two side faces, and a rear shell having a top face and a rear face, is attached thereto so that the housing can be protectively enclosed.

8. A shielded electrical connector for mating with a complementary cable connector, comprising:

an insulative housing including a cavity therein with a plurality of contacts in communication with said cavity;

said cavity defined by a first wall and a second wall opposite to said first wall and by two opposite side walls; and a shell covering at least a mating surface of said housing, said shell defining an opening in compliance with and in alignment with said cavity of the housing; wherein said first wall of the housing includes a first recess extending from the mating surface rearward and communicable with said cavity for receiving therein a locking plate extending rearward from a first edge by said opening of said shell, and said locking plate includes one latching finger having an embossment thereon so that such embossment can latchably engaged within an opening of a plug section of the complementary cable connector.

9. The shielded electrical connector as described in claim 8, wherein said second wall of the housing includes a second recess extending from the mating surface rearward and communicable with said cavity for receiving therein a reinforcement device extending from a second edge by said opening.

10. The shielded electrical connector as described in claim 9, wherein said first edge and said second edge extend in a longitudinal direction with regard to said opening.

11. The shielded electrical connector as described in claim 10, wherein said reinforcement device includes at least a strap, and said strap and said latching finger are offset with each other in their horizontal positions.

12. The shielded electrical connector as described in claim 8, wherein said housing further includes at least a third recess in a third wall which is perpendicular to the first and the second walls for receiving at least a grounding tab extending from a side edge of said opening of the shell.

13. The shielded electrical connector as described in claim 8, wherein said shell further includes at least a grounding tang extending and obliquely forward, and the housing includes at least an aperture for receiving said grounding tang therein when said grounding tang is deflected.

14. A shield made by stamping from a plate blank for use with a shielded electrical connector, comprising:

a front shell including at least a front face forming therein at least a rectangular opening defined by two opposite longitudinal edges and two opposite side edges;

a reinforcement device extending rearward from one of said longitudinal edge and including at least a strap; and a locking plate extending rearward from the other of said longitudinal edge and including at least a latching finger; wherein said strap and said latching finger are arranged in a staggered manner with each other on said plate blank for not overlapping with each other to assure they all have sufficient dimensions for their own strength consideration.

15. The shield as described in claim 14, wherein said front shell further includes at least a grounding tab extending rearward from one of said side edge.

16. The shield as described in claim 15, wherein said front shell further includes at least a grounding tang extending forward therefrom.

17. The shield as described in claim 14, wherein said shield further includes a rear shell.

18. The shield as described in claim 17, wherein said front shell further includes two side faces, and said rear shell includes a top face and a rear face.

* * * * *